US011530062B2

(12) United States Patent
Glazebrook

(10) Patent No.: US 11,530,062 B2
(45) Date of Patent: Dec. 20, 2022

(54) GAS FLUSH INJECTOR

(71) Applicant: Proseal UK Limited, Adlington (GB)

(72) Inventor: Thomas Glazebrook, Macclesfield (GB)

(73) Assignee: Proseal UK Limited, Adlington (GB)

( * ) Notice: Subject to any disclaimer, the term of this patent is extended or adjusted under 35 U.S.C. 154(b) by 1 day.

(21) Appl. No.: 17/271,586

(22) PCT Filed: Aug. 28, 2019

(86) PCT No.: PCT/GB2019/052395
§ 371 (c)(1),
(2) Date: Feb. 25, 2021

(87) PCT Pub. No.: WO2020/044031
PCT Pub. Date: Mar. 5, 2020

(65) Prior Publication Data

US 2021/0339899 A1 Nov. 4, 2021

(30) Foreign Application Priority Data

Aug. 29, 2018 (GB) ..... 1814031

(51) Int. Cl.
*B65B 31/02* (2006.01)
*B65B 7/16* (2006.01)

(52) U.S. Cl.
CPC ..... *B65B 31/028* (2013.01); *B65B 7/164* (2013.01); *B65B 31/025* (2013.01)

(58) Field of Classification Search
CPC ..... B65B 7/164; B65B 31/025; B65B 31/028
(Continued)

(56) References Cited

U.S. PATENT DOCUMENTS 1,679,386 A * 8/1928 Tenney ..... B65B 31/025 141/148
3,332,201 A * 7/1967 Cooper ..... B65B 31/025 53/88

(Continued)

FOREIGN PATENT DOCUMENTS

DE 3206712 A * 9/1983 ..... B65B 39/00
EP 1842776 A2 10/2007
WO 85/00339 A1 1/1985

OTHER PUBLICATIONS

International Search Report and Written Opinion dated Nov. 18, 2019, issued in corresponding International Application No. PCT/GB2019/052395, filed Aug. 28, 2019, 10 pages.

*Primary Examiner* — Stephen F. Gerrity
(74) *Attorney, Agent, or Firm* — Christensen O'Connor Johnson Kindness PLLC

(57) ABSTRACT

Packaging apparatus, such as a tray sealer, with a gas supply arrangement enabling a flushing gas to be conducted between a flushing gas outlet (26) and a flushing gas inlet (14) which are relatively moveable. The flushing gas inlet is positioned above the flushing gas outlet. The gas supply arrangement includes a barrel 15 connected to the inlet (14) and sliding in a sleeve connected to the outlet (26). In a first predetermined relative position of the flushing gas outlet and flushing gas inlet a fluid flow connection is established between the flushing gas outlet and flushing gas inlet. In a second predetermined relative position the flushing gas inlet and flushing gas outlet are disconnected and liquid may drain from the barrel 15.

22 Claims, 4 Drawing Sheets

(58) Field of Classification Search
USPC ..... 53/510, 511
See application file for complete search history.

(56) References Cited

U.S. PATENT DOCUMENTS

| | | | | |
|---|---|---|---|---|
| 5,419,096 | A * | 5/1995 | Gorlich | B65B 31/028 53/329.3 |
| 9,150,316 | B2 * | 10/2015 | Vaccari et al. | B65B 31/028 |
| 2001/0017021 | A1 | 8/2001 | Sanfilippo et al. | |
| 2009/0301658 | A1 | 12/2009 | Vine et al. | |
| 2013/0247510 | A1 | 9/2013 | Harlacher et al. | |
| 2016/0339484 | A1 | 11/2016 | Mader | |

* cited by examiner

GAS FLUSH INJECTOR

TECHNICAL FIELD OF THE INVENTION

The present invention relates to packaging apparatus and particularly to heat sealing packaging apparatus such as a tray sealer.

BACKGROUND TO THE INVENTION

Tray sealers are widely used to package foodstuffs. Conventional tray sealers have a lower tool for supporting trays containing foodstuff which in use is raised to bring it into contact with a sealing film positioned above the trays and to urge the film and rims of the trays into contact with a heated upper tool. This seals the film to the rims of the trays and cuts the film around each individual tray.

To prolong the shelf life of foodstuff packaged in this way it is known to flush the trays with a chosen, typically inert, gas before they are sealed with film. This displaces air from the trays, replacing it with the inert gas which slows oxidation or other deterioration of the packaged foodstuff.

To achieve this the lower tool of a tray sealer is provided with ports through which the inert gas is supplied. The inert gas is introduced into the tray whilst the tray is near or in contact with the sealing film, but before the film is sealed to the tray. The inert gas is supplied from a gas cylinder or other external gas supply via a valve of the tray sealer which is controlled by the machine so that gas is only discharged when required.

To accommodate the movement of the lower tool relative to the remainder of the tray sealer the lower tool is connected to the gas supply using a flexible hose which follows a U-shaped path from a gas outlet downstream of the control valve to an inlet of the lower tool, or of a support to which lower tool is mounted.

The flexible hose causes problems. During operation or cleaning of the machine matter such as foodstuff, contaminated cleaning water or other matter may enter the pipe either via the lower tool or directly when the lower tool is removed for cleaning of the machine. Such matter builds up in the U-shaped bend in the hose and may lead to growth of bacteria in the hose. When the machine is next operated flow of gas through the hose drives the matter into the lower tool and packaging, potentially contaminating foodstuff packaged by the machine. To guard against this risk it is necessary to periodically clean the hose. This involves removing it from the machine. To facilitate this both ends of the hose need to be easily accessible. One end will be connected to or near to the lower tool and so can relatively easily be accessed. The other end is connected to a gas outlet on the machine and so this also needs to be placed in a conveniently accessible location which places design constraints on the machine.

It is an object of embodiments of the present invention to address these problems.

SUMMARY OF THE INVENTION

According to an aspect of the present invention there is provided packaging apparatus comprising a flushing gas outlet for connection to a gas supply, a flushing gas inlet and a gas supply arrangement enabling a flushing gas to be conducted between the flushing gas outlet and the flushing gas inlet. The flushing gas inlet is positioned above and is moveable relative to the flushing gas outlet.

The gas supply arrangement is arranged such that when the flushing gas outlet and flushing gas inlet are in a first predetermined relative position, or range of positions, a fluid flow connection is established between the flushing gas outlet and flushing gas inlet. When the flushing gas outlet and flushing gas inlet are in a second predetermined relative position, or range of positions, the flushing gas inlet and flushing gas outlet are disconnected and the flushing gas inlet can drain via the gas supply arrangement.

The gas supply arrangement accommodates movement in a packaging machine by connecting a gas supply only when required. For a tray sealer this would be when a lower tool is in a raised gas flush position. In a lower rest position the gas supply is disconnected and so the gas supply arrangement (or the part of it which connects to the lower tool) can be more easily flushed to clean it. As the gas supply disconnects automatically there are fewer design constrains on the positioning of the outlet as a user does not need to regularly access it. This in turn allows it to be placed as close to the inlet as possible and minimises the size of, and thus volume of gas contained by, the gas supply arrangement. This reduces the amount of gas required to flush through the machine and so reduces gas consumption. As the flushing gas inlet can drain via the gas supply arrangement, this facilitates cleaning of the gas supply arrangement.

The apparatus may be further arranged so that when the outlet and inlet are in a second predetermined relative position, or range of positions, the outlet is closed. This reduces the risk of contamination of the outlet, and so further facilities freedom of positioning of the outlet on the machine.

The part of the gas supply arrangement connected to the flushing gas inlet is preferably configured so that it will drain completely. That is to say all surfaces which define a conduit for gas are, in use, inclined so that any liquid in the conduit will flow towards an opening. This way any liquid should drain from the opening.

The gas supply apparatus may comprise a conduit. The conduit may establish a fluid flow connection between the flushing gas outlet and the flushing gas inlet when they are in the first predetermined relative position, or range of positions. The conduit may disconnect from the gas outlet when the flushing gas outlet and flushing gas inlet are in the second predetermined relative position, or range of positions, so that no fluid flow connection is established between the flushing gas outlet and flushing gas inlet. Any suitable arrangement may be employed for establishing a temporary connection between the conduit and the flushing gas outlet.

In one embodiment the conduit is defined by a barrel. The conduit extends from an opening on the side of the barrel and connects (directly or indirectly) to the inlet. The barrel may be movably mounted to, or relative to, a structure comprising the flushing gas outlet. The barrel may be elongate and arranged to move along its long axis. In use the long axis of the barrel may extend substantially vertically. This facilitates draining of the barrel. The conduit may extend from the opening on the side of the barrel, which may be positioned towards one end of the barrel, to an opening towards the opposite end of the barrel, which may be in an end face of the barrel. This opening may be connected to the inlet.

The conduit may be formed by a bore through the barrel which extends to the opening in the side of the barrel in a smooth curve. This ensures that there are no traps for water or other material in the barrel and so facilitates complete draining of the barrel through the opening.

The barrel may be substantially circular in cross-section. The cross-section of the barrel may be substantially constant over the majority of its length but reduced in the region of the opening. For a barrel of substantially circular cross-section this may give it an hour-glass or waisted appearance in the region of the opening.

The structure may define a bore through which the barrel extends, the outlet being in fluid connection with an opening into the bore between its ends. The bore may be defined by a sleeve. One or more bushes may be provided for slidably mounting the rod relative to the bore. A bush may be provided at either side of the opening into the bore. Where the bore is defined by a sleeve a bush may be positioned at each opposite end of the sleeve. The/or each bush may have a close sliding fit with the barrel and there may be a clearance between the bore and the barrel. This allows gas to flow around the barrel within the bore and thus allows some tolerance of positioning of the barrel in the bore to establish a fluid communication between the outlet and the opening into the barrel.

A seal or seals may be arranged effect a fluid flow connection between the flushing gas outlet and the opening of the barrel. Where the apparatus comprises a barrel extending in a bore a respective seal may be provided to effect a seal between the barrel and bore to each side of the flushing gas outlet. An annular seal, such as a lip seal, is suitable where the barrel and bore have substantially circular cross-sections. Provision of a seal reduces leakage of gas from the apparatus.

The flushing gas inlet may be provided on a tool of the machine or a support for a tool of the machine, either being arranged to move up and down relative to the flushing gas outlet during operation of the machine. In this case the gas supply apparatus may establish a fluid flow connection between the flushing gas outlet and flushing gas inlet when the tool or support for a tool is in an upper, gas flush, position. Also, the gas supply apparatus may be arranged to disconnect the flushing gas inlet and flushing gas outlet and allow the inlet to drain through the gas supply apparatus when the tool or support for a tool is in a lower, rest, position.

The apparatus may be heat sealing apparatus. The apparatus may be a tray sealer.

According to another aspect of the present invention there is provided packaging apparatus comprising a gas supply arrangement enabling a flushing gas to be conducted between a flushing gas outlet and a flushing gas inlet which are relatively movable. The gas supply arrangement may comprise a barrel defining a conduit extending from an opening on the side of the barrel and connecting to the flushing gas inlet. The barrel may be moveably mounted to a structure comprising the flushing gas outlet. Also, the barrel may be arranged such that when the flushing gas outlet and flushing gas inlet are in a first relative position, or range of positions, a fluid flow connection is established between the flushing gas outlet and the opening on the side of the barrel. As such, a fluid flow connection is established between the flushing gas outlet and the flushing gas inlet. When the flushing gas outlet and flushing gas inlet are in a second predetermined relative position, or range of positions, the flushing gas inlet and flushing gas outlet are disconnected. This enables the inlet may drain through the opening on the side of the barrel.

DETAILED DESCRIPTION OF THE INVENTION

In order that the invention may be more clearly understood one or more embodiments thereof will now be described, by way of example only, with reference to the accompanying drawings, of which:

Figure 4:
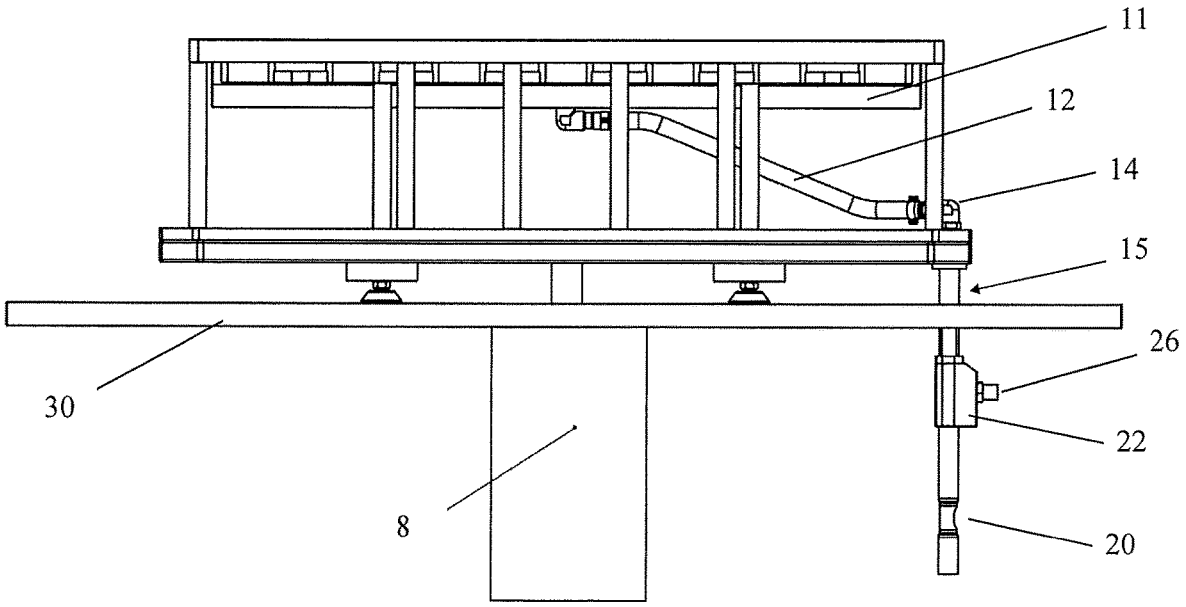
FIG. 4 shows part of the machine of FIG. 1 with the lower tool in a rest position.
Figure 3:
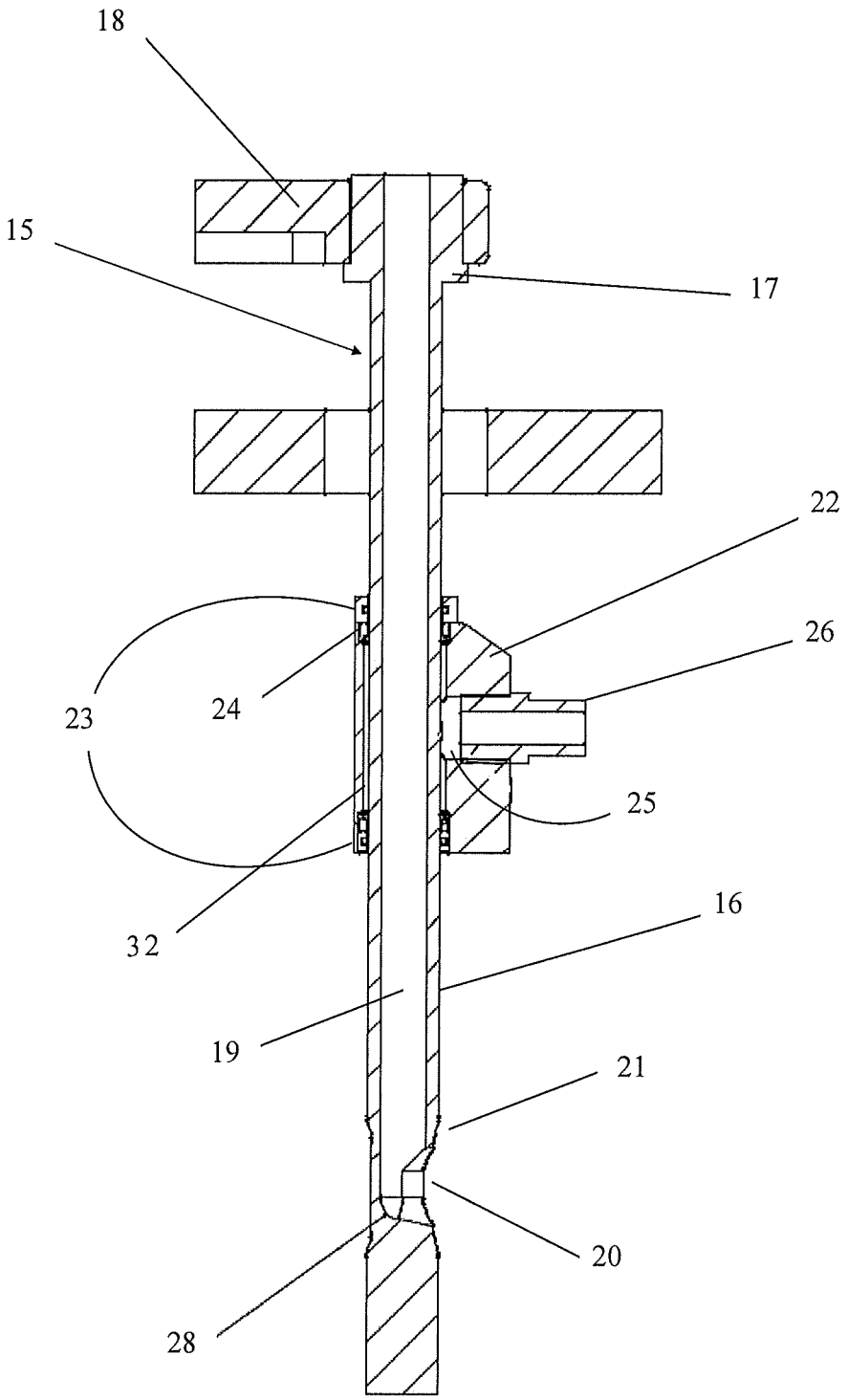
FIG. 3 is a partial enlargement of FIG. 2.
Figure 5:
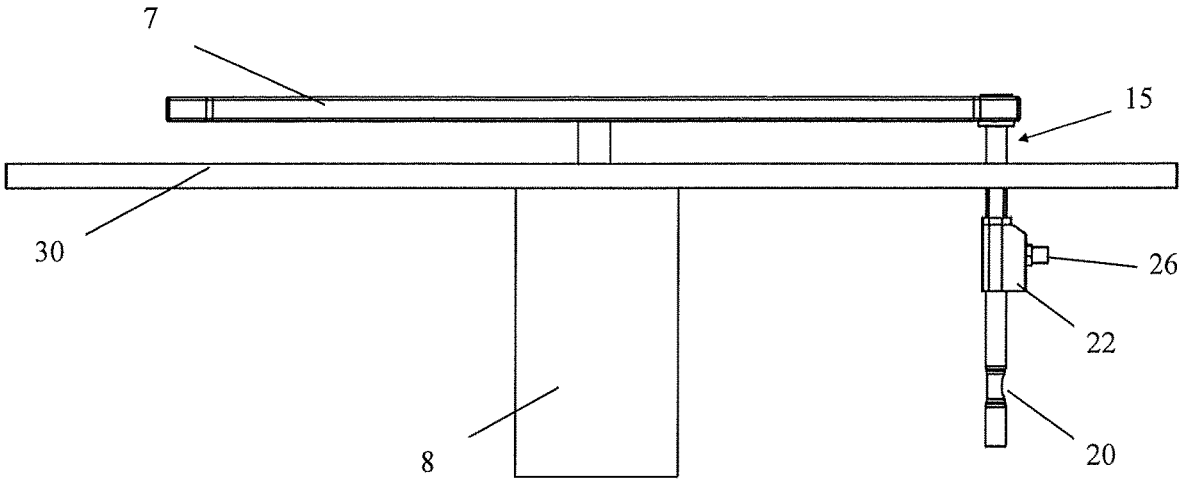

FIG. 5 corresponds to FIG. 4, but with the lower tool removed; and

Figure 6:
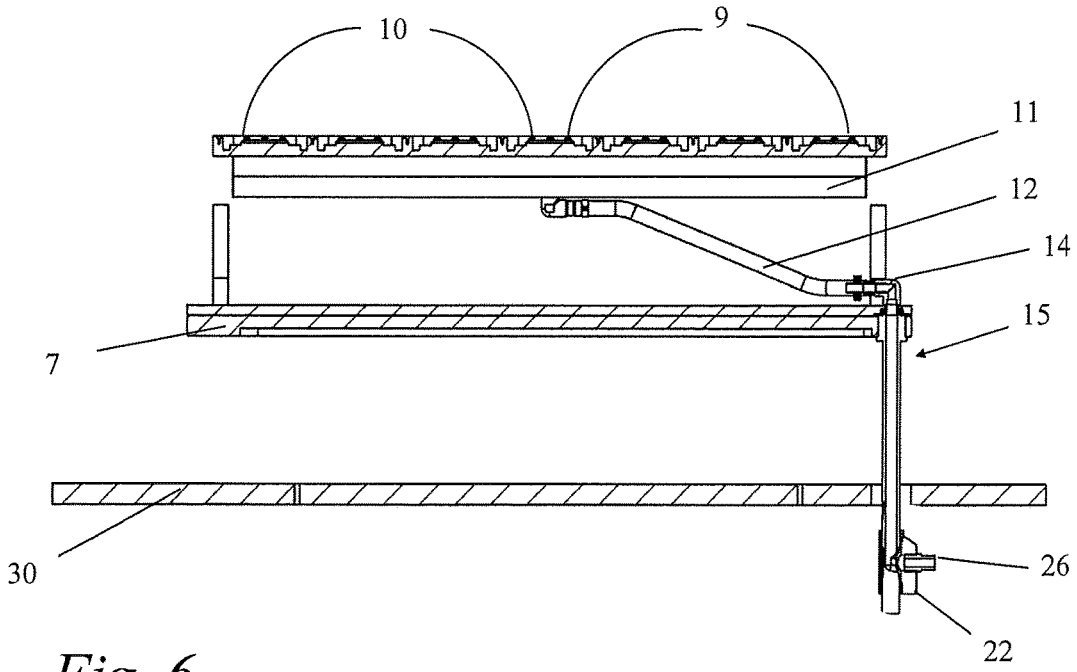

FIG. 6 corresponds to FIG. 4 but with the lower tool in a gas flush position.

References to upper and lower and like terms refer to the apparatus when oriented as shown in the drawings (which is the orientation in which it is normally intended to be used) but should not be otherwise taken as limiting.

Referring to the drawings there is shown a tray sealing machine 1. The machine is of a largely conventional type except as explained below and is therefore not described in detail. Briefly, the machine is for sealing trays and comprises infeed 2 and outfeed 3 conveyors under protective guards for feeding unsealed trays towards and sealed trays away from a sealing station 4. Trays are carried into the sealing station 4 from the infeed conveyor 2 and out of the sealing station 4 to the outfeed conveyor 3 by transfer arms (not shown).

The sealing station 4 comprises a lower tool 5 and an upper tool 6.

The lower tool 5 is supported on a platform 7. The platform 7 is mounted to an actuator 8 operable to raise and lower the platform 7 and thus the lower tool 5 relative to the rest of the machine. The lower tool 5 is arranged to receive trays to be sealed, and includes gas outlet ports 9 via which a flushing gas can be directed into trays received in the tool and gas inlet ports 10 through which gas flushed from trays can escape to the atmosphere. The gas outlet ports 9 are connected, via a manifold 11, to a flushing gas inlet in the lower tool 5 to which is connected a gas supply pipe 12.

The upper tool 6 is positioned above the lower tool 5 in a fixed position. The upper tool 6 is heated and in use a sealing film (not shown) extends between the two tools adjacent the upper tool 6.

Figure 1:
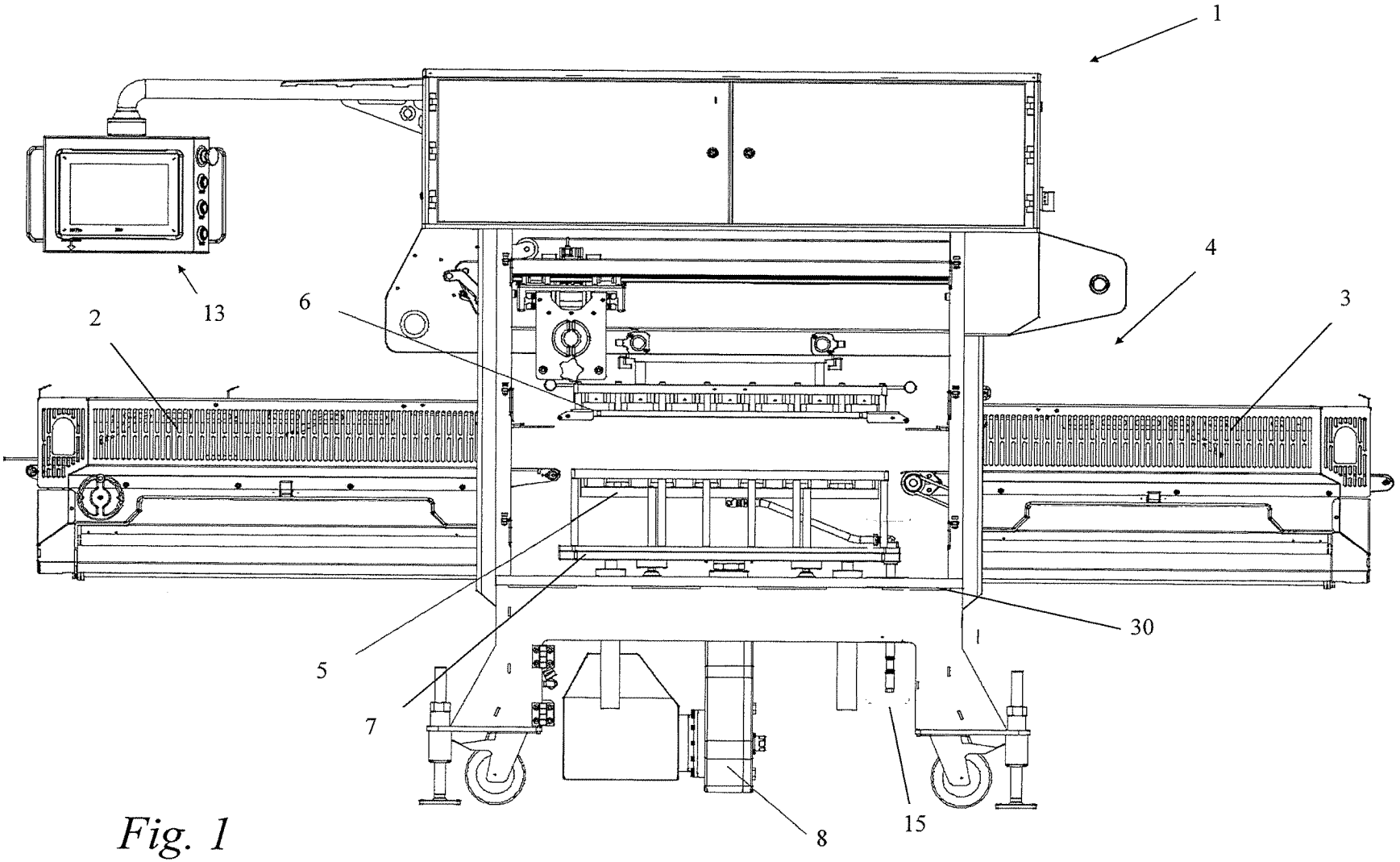
FIG. 1 is a schematic, part cut away, diagram of a tray sealing machine.
Figure 2:
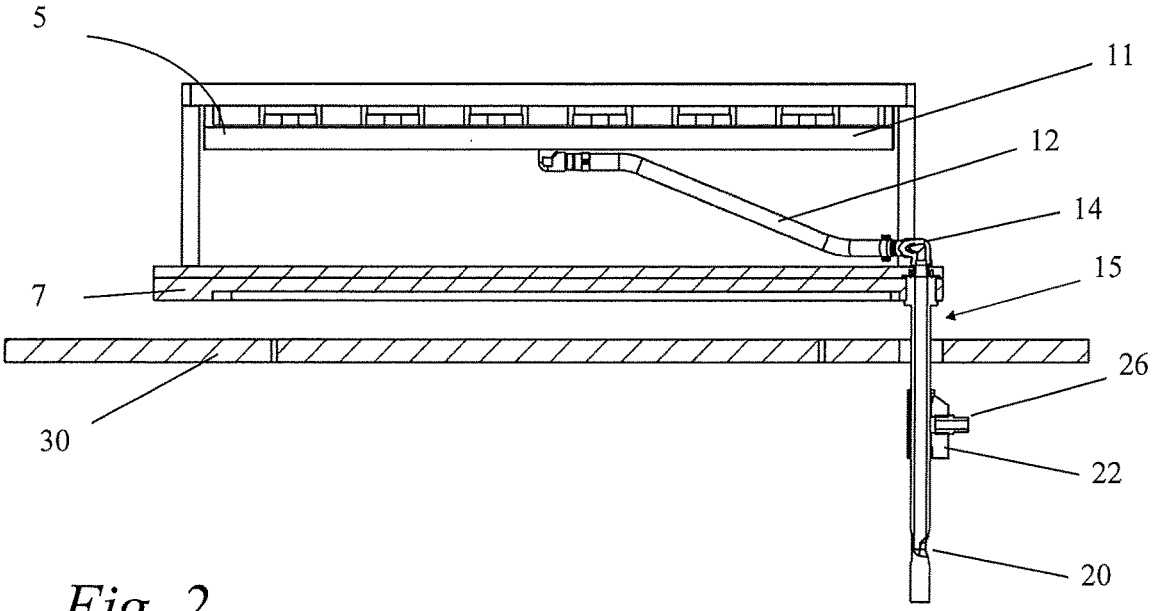
FIG. 2 is an enlarged vertical cross-section of the gas supply arrangement of the machine of FIG. 1.

In use, trays containing product to be packaged, typically a foodstuff, are transferred into the lower tool 5 with the lower tool 5 being in a rest position as shown in FIGS. 1 and 2.

The actuator 8 then raises the platform 7 and thus the lower tool 5 to a gas flushing position, as shown in FIG. 6. In this position rims of the trays are just in contact or nearly in contact with the sealing film, which substantially closes the trays. A flushing gas is then introduced under pressure via the gas outlet ports 9 in the lower tool 5 which displaces air in the trays out of the inlet ports 10 in the lower tool 5.

After a predetermined time the gas flow is stopped and the actuator 8 raises the lower tool 5 further to a sealing position in which the rims of the trays are urged into contact with the upper tool 6, sandwiching the sealing film between the rims and the heated upper tool 6 and cutting the sealing film around each tray. This seals film to each tray, closing the tray and trapping the flushing gas inside.

The actuator 8 then lowers the platform 7 to return the lower tool 5 to the rest position and the sealed trays are transferred to the outfeed conveyor 3.

A programmable electronic controller 13 automatically controls operation of the machine 1.

These features of a tray sealing machine will be well understood by a person of ordinary skill in the art. Where the machine differs from a conventional machine, though, is the manner in which the gas supply pipe of the lower tool is connected to a gas supply.

The gas supply pipe 12 is connected via an elbow 14, which forms a flushing gas inlet to the lower tool, to a barrel 15.

The barrel 15 is formed from a cylindrical, elongate rod 16. Over the majority of its length the rod 16 has a substantially constant external diameter. At the top of the rod 16 there is a short section with an increased diameter which terminates with a projecting shoulder 17, beyond which the diameter is reduced. The region of increased diameter is received into an aperture in the platform 7 of the lower tool 5 with a close fit such that the projecting shoulder 17 abuts the platform 7 and the top end of the rod 16 protrudes slightly from the surface of the platform 7.

A substantially cylindrical bore 19 is formed in the rod 16 from the top of the rod 16 and extends over most but not all the length of the rod 16, about ⅛ of the length of the rod 16 from its lower end being solid. Just above the solid portion an opening 20 is formed in the side of the rod 16 into the bore 19. The inside walls of the bore 19 approach the opening in a smooth concave curve 28 so that when the rod 16 is upright any liquid in the bore 19 can drain out of the opening 20 and not become trapped in the bore 19. In the region 21 around the opening 20 the external diameter of the rod is decreased, transitioning from the diameter of the majority of the length of the rod 16 in a smooth curve.

The major axis of the rod 16 extends substantially vertically.

Whilst described as a bored rod 16, the barrel 15 could of course be constructed using any suitable technique. For example, it could be fabricated from a length of pipe.

The barrel 15 extends through an aperture in the sealing station floor 30 into a region below the sealing station 4 and through a sleeve 22 mounted to the machine 1. The sleeve 22 is fixed relative to the machine 1 so that as the lower tool 5 is raised and lowered by the actuator 8 and platform the rod 16 slides within the sleeve 22.

The sleeve 22 defines a cylindrical bore 32 through which the barrel 15 extends. The bore is of a greater diameter than the barrel 15. A lip seal 23 and guide bush 24 is fitted into a counter bore at each opposite end of the sleeve, the bushes 24 holding the seals 23 in place. The bushes 24 and seals 23 centre the barrel 15 within the sleeve 22 so that there is a clearance all around the barrel 15 within the sleeve 22, allow for the smooth running of the barrel 15 through the sleeve 22 and form a substantially gas tight seal between the barrel 15 and the sleeve 22.

A radial bore 25 is formed in the sleeve 22 and connects to a fitting 26 enabling connection, in use, to a gas supply and so forming a flushing gas outlet on the machine.

The barrel 15 and sleeve 22 are arranged so that the radial opening 20 in the barrel 15 faces the radial bore 25 in the sleeve 22 when the two are aligned.

The length of the barrel 15 is such that when the upper tool 6 is in the gas flush position the radial opening 20 in the barrel 15 faces the radial bore 25 in the sleeve 22, or is at least between the lip seals 23 in the top and bottom of the sleeve 22. In this position gas introduced from a supply through the fitting 26 into the radial bore 25 in the sleeve 22 will flow into the bore 19 in the barrel 15 and via the supply pipe 12 into the lower tool 5. Although preferred, it is not essential that the radial opening 20 of the barrel faces the radial bore 25 in the sleeve 22 as the reduced outside diameter of the barrel 21 in the region of the radial opening 20 provides for an increased clearance around the barrel 15 in the sleeve 22 for gas to flow around the barrel 15 and into the opening 20. Some tolerance over vertical positioning of the barrel 15 in the sleeve 22 is also afforded as the region of reduced diameter 21 is shorter than the distance between the lip seals 23. Also, as the barrel moves through the sleeve 22 the reduction in diameter where the aperture 20 is formed is sufficient to prevent edges of the aperture 20 catching on the lip seals 23 thereby preventing damage and degradation over time.

When the upper tool 6 is lowered from the gas flush position, and in particular when it is in the rest position, the part of the barrel 15 in which the radial opening 20 is formed is below the sleeve 22 and material may drain from the barrel 15 via the radial aperture 20.

This feature is advantageous when cleaning the machine 1 with the lower tool 5 removed, as shown in FIG. 5, or indeed just with the pipe connection to the lower tool 5 removed from the top of the barrel 15, as water or another cleaning liquid may be flushed through the barrel 15, draining freely from the radial opening 20.

In all positions the barrel 15 extends through the sleeve 22 and so the lip seals 23 help prevent contamination of the interior of the sleeve 22.

It is envisaged that the supply of gas to the sleeve 22 is controlled by the machine 1, as with conventional machines. This may be effected by a machine controlled gas valve disposed in a conduit running from a supply of gas to the fitting 26 on the sleeve. Alternatively, gas could be continuously supplied, but will only flow to the lower tool 5 when the radial opening 20 in the barrel 15 is at least partially between the lip seals 23 of the sleeve 22. Otherwise flow of gas from the supply will be substantially prevented by the lip seals 23.

The gas supply arrangement replaces the flexible hose of conventional machines and thus overcomes the problems of such hoses harbouring moisture and other contaminants in a u-bend, allowing contaminants to be blown into the lower tool and being difficult to clean. It also enables the gas outlet to be positioned closer to the inlet and reduces the volume of gas in the supply arrangement in between the two as compared to a conventional flexible hose.

The above embodiment is described by way of example only. Many variations are possible without departing from the scope of the invention as defined in the appended claims.

The invention claimed is:

1. A gas flush injector for a packaging apparatus having an upper tool and a lower tool, the injector comprising:

a flushing gas outlet for connection to a gas supply, a flushing gas inlet in communication with the packaging apparatus lower tool, and a gas supply arrangement comprising a conduit enabling a flushing gas to be conducted through the conduit between the flushing gas outlet and the flushing gas inlet, wherein the flushing gas inlet is positioned above and is moveable relative to the flushing gas outlet, and wherein the gas supply arrangement is arranged such that when the flushing gas outlet and the flushing gas inlet are in a first predetermined relative position a fluid flow connection is established through the conduit between the flushing gas outlet and the flushing gas inlet, and such that when the flushing gas outlet and the flushing gas inlet are in a second predetermined relative position the flushing gas inlet and the flushing gas outlet are disconnected and the flushing gas inlet can drain through the conduit in a direction away from the flushing gas inlet.

2. The injector as claimed in claim 1 wherein when the flushing gas outlet and the flushing gas inlet are in the second predetermined relative position the flushing gas outlet is closed.

3. The injector as claimed in claim 1, wherein when the flushing gas outlet and the flushing gas inlet are in the first predetermined relative position the lower tool is in an upward position relative to the upper tool, and when the flushing gas outlet and the flushing gas inlet are in the second predetermined relative position the lower tool is in a downward position relative to the upper tool, so that no fluid flow connection is established between the flushing gas outlet and the flushing gas inlet.

4. The injector as claimed in claim 1 wherein the conduit is defined by a barrel and extends from an opening on the side of the barrel to connect with the flushing gas inlet.

5. The injector as claimed in claim 4 wherein the barrel is elongate and arranged to move along its long axis, the apparatus being arranged so that in use the long axis of the barrel extends substantially vertically.

6. The injector as claimed in claim 5, wherein the opening on the side of the barrel has a lower portion that is beveled in the radially outward direction relative to the long axis of the barrel.

7. The injector as claimed in claim 5, wherein the injector is separable from the lower tool by retracting the lower tool upwardly, thereby to expose the flushing gas inlet for access to cleaning.

8. The injector as claimed in claim 4 wherein a bore extends through the barrel to the opening in the side of the barrel in a smooth curve.

9. The injector as claimed in claim 4 wherein the barrel is substantially circular in cross-section.

10. The injector as claimed in claim 4 wherein the cross-section of the barrel is substantially constant over a majority of a length of the barrel, but reduced in the region of the opening.

11. The injector as claimed in claim 4 wherein the barrel is movably mounted to a structure comprising the flushing gas outlet.

12. The injector as claimed in claim 11 wherein the structure defines a bore through which the barrel slidably extends, and the flushing gas outlet is in fluid connection with an opening into the bore between ends of the bore.

13. The injector as claimed in claim 12 wherein the structure comprises a sleeve which defines the bore.

14. The injector as claimed in claim 12 comprising one or more bushes slidably mounting the barrel relative to the bore.

15. The injector as claimed in claim 12 comprising a seal provided to effect a seal between the barrel and the bore through which the barrel extends at each side of the opening into the bore.

16. The injector as claimed in claim 4, wherein the opening on the side of the barrel establishes a fluid flow connection between the flushing gas outlet and the flushing gas inlet when the flushing gas outlet and the flushing gas inlet are in the first predetermined relative position, and disconnects the flushing gas outlet when the flushing gas outlet and flushing gas inlet are in the second predetermined relative position so that no fluid flow connection is established between the flushing gas outlet and the flushing gas inlet and the flushing gas inlet can drain through the conduit and out the opening on the side of the barrel.

17. The injector as claimed in claim 1 comprising a seal or seals arranged to effect a fluid flow connection between the flushing gas outlet and the conduit.

18. The injector as claimed in claim 1 wherein the flushing gas inlet is provided on the lower tool of the packaging apparatus or a support for the lower tool of the packaging apparatus arranged to move up and down relative to the flushing gas outlet during operation of the packaging apparatus.

19. The injector as claimed in claim 18 wherein the gas supply apparatus establishes a fluid flow connection between the flushing gas inlet and the flushing gas outlet when the lower tool or the support for the lower tool is in an upper, gas flush, position.

20. The injector as claimed in claim 18 wherein the gas supply apparatus is arranged to disconnect the flushing gas inlet and the flushing gas outlet and allow the flushing gas inlet to drain through the gas supply apparatus when the lower tool or the support for the lower tool is in a lower, rest, position.

21. The injector as claimed in claim 1 wherein the packaging apparatus comprises a heat sealing apparatus.

22. The injector as claimed in claim 21 wherein the packaging apparatus comprises a tray sealer.

* * * * *